US007341173B1

(12) United States Patent
Arnold

(10) Patent No.: US 7,341,173 B1
(45) Date of Patent: Mar. 11, 2008

(54) EXHAUST GAS DIFFUSER AND FILTER SYSTEM FOR A PNEUMATIC NAIL GUN

(76) Inventor: John L. Arnold, 203 Fox Hollow Rd., Lynchburg, VA (US) 24503

( * ) Notice: Subject to any disclaimer, the term of this patent is extended or adjusted under 35 U.S.C. 154(b) by 0 days.

(21) Appl. No.: 11/583,035

(22) Filed: Oct. 19, 2006

Related U.S. Application Data

(60) Provisional application No. 60/849,457, filed on Oct. 5, 2006.

(51) Int. Cl.
*B25C 5/00* (2006.01)
*F01N 1/00* (2006.01)

(52) U.S. Cl. ..... 227/120; 227/156; 181/230; 173/DIG. 2

(58) Field of Classification Search ..... 227/120, 227/129, 130, 156; 181/230, 212, 217, 225; 173/DIG. 2
See application file for complete search history.

(56) References Cited

U.S. PATENT DOCUMENTS 1,115,704 A * 11/1914 Manes ..... 181/230
2,949,975 A * 8/1960 Plummer ..... 181/230
3,032,139 A * 5/1962 Gildone ..... 181/252
3,225,861 A * 12/1965 Reynolds ..... 181/230
3,379,278 A * 4/1968 Skowron ..... 181/230
3,824,745 A * 7/1974 Hutchins ..... 451/359
3,891,049 A * 6/1975 Stroezel et al. ..... 181/230
3,949,828 A * 4/1976 Frochaux ..... 181/230
4,113,052 A * 9/1978 McElroy, Jr. ..... 181/230
4,134,472 A * 1/1979 Trainor ..... 181/258
4,139,137 A * 2/1979 Gupta ..... 227/123
4,303,425 A * 12/1981 Cox, Jr. ..... 55/378
4,778,015 A 10/1988 Jacobsson
4,892,413 A * 1/1990 Vats ..... 366/349
4,981,247 A * 1/1991 Noll ..... 227/156
5,025,970 A * 6/1991 Anderson et al. ..... 227/156
5,199,501 A * 4/1993 Kluber et al. ..... 173/75
5,244,521 A * 9/1993 Ligman ..... 156/85
5,560,528 A * 10/1996 Chen ..... 227/130
5,581,055 A * 12/1996 Self et al. ..... 181/230
5,927,584 A 7/1999 Akiba
5,992,540 A * 11/1999 Smolinski et al. ..... 173/169
6,047,693 A * 4/2000 Yamami et al. ..... 125/13.01
6,059,166 A * 5/2000 Ho et al. ..... 227/130

(Continued)

FOREIGN PATENT DOCUMENTS

GB 2078608 1/1982

*Primary Examiner*—Rinaldi I. Rada
*Assistant Examiner*—Paul Durand
(74) *Attorney, Agent, or Firm*—Richard C. Litman

(57) ABSTRACT

The exhaust gas diffuser and filter system for a pneumatic nail gun provides for the diffusion and filtering of exhaust gas, which is typically pressurized air, generated by the pneumatic nail gun during usage thereof. The system includes a diffuser plate adapted for covering the exhaust ports of the pneumatic nail gun, and further includes a bag formed from an air permeable material, allowing for further diffusion and filtering of the exhaust gas. The diffuser plate has a plurality of fluid passages formed therethrough, and is adapted for releasable mounting on the exhaust portion of the pneumatic nail gun. The plurality of fluid passages diffuses the exhaust gas produced by the pneumatic nail gun during use. The bag provides for further muffling of exhaust noise and diffusion of the exhaust gas, and further provides filtering thereof.

17 Claims, 3 Drawing Sheets

U.S. PATENT DOCUMENTS 6,199,383 B1 * 3/2001 Pusateri ..... 60/695
6,671,931 B1 * 1/2004 Duncan ..... 16/435
6,755,260 B1 * 6/2004 Allan ..... 173/162.2
2006/0107432 A1 5/2006 Cicero

* cited by examiner

EXHAUST GAS DIFFUSER AND FILTER SYSTEM FOR A PNEUMATIC NAIL GUN

CROSS-REFERENCE TO RELATED APPLICATION

This application claims the benefit of U.S. Provisional Patent Application Ser. No. 60/849,457, filed Oct. 5, 2006.

BACKGROUND OF THE INVENTION

1. Field of the Invention

The present invention relates to pneumatic tools, and particularly to an exhaust gas diffuser and filter system for a pneumatic nail gun that muffles the exhaust noise and prevents the pressurized air in the exhaust from stirring up dust and airborne particles during the exhaust cycle.

2. Description of the Related Art

FIG. 1 illustrates a conventional pneumatic-type nail gun 12, having a pistol grip handle portion 13 and an upper end 14 through which exhaust gas is ejected from the system. Typical nail guns 12, such as that shown, generally include a cover plate 18, for covering exhaust ports 16, formed through upper end 14. Exhaust gas is directed through a single exhaust port 20 of cover plate 18 in a unidirectional manner. Typical cover plates 18 generally have a central axial bore formed therethrough for receiving a threaded bolt 22 or the like for attaching the cover plate 18 to the upper end 14 of nail gun 12.

In the prior art system shown in FIG. 1, port 20 directs a relatively large volume of exhaust gas through a relatively small passage, and in only one direction. This unidirectional high pressure stream of exhaust gas is not only exceptionally noisy (which may be damaging to the user's hearing), but may pose an environmental hazard in the workplace. Further, the exhaust gas is not filtered in any way, thus allowing contaminants and noxious gases to be expelled into the environment about the user, the single large, concentrated jet of air stirring up dust and debris as the tool cycles, which may be hazardous to the respiratory system.

Thus, an exhaust gas diffuser and filter system for a pneumatic nail gun solving the aforementioned problems is desired.

SUMMARY OF THE INVENTION

The exhaust gas diffuser and filter system for a pneumatic nail gun provides for the diffusion and filtering of exhaust gas, which is typically pressurized air, generated by the pneumatic nail gun during usage thereof. The system includes a diffuser plate adapted for covering the exhaust ports of the pneumatic nail gun, and further includes a bag formed from an air permeable material, allowing for further diffusion and filtering of the exhaust gas. The diffuser plate has a plurality of fluid passages formed therethrough, and is adapted for attachment to the exhaust portion of the pneumatic nail gun in place of the existing cap or cover plate. The plurality of fluid passages diffuses the exhaust gas produced by the pneumatic nail gun during use.

Preferably, the diffuser plate has an axial bore formed therethrough for receiving a bolt or the like for attaching the diffuser plate to the exhaust portion of the pneumatic nail gun. Typical pneumatic nail guns, such as the prior art nail gun 12 illustrated in FIG. 1, include cover plates, such as cover plate 18. Preferably, the diffuser plate of the present invention replaces cover plate 18, and the original bolt 22 may be used to secure the diffuser plate to the exhaust portion.

The bag includes an upper closed portion and a lower open portion, and is sized and shaped to cover the exhaust portion of the pneumatic nail gun. The bag is preferably formed from an at least partially air permeable material. Preferably, the entire bag is formed from an air permeable material to diffuse and filter the exhaust gas, and the lower portion of the bag is coated with material having a relatively high coefficient of friction, allowing for enhanced gripping thereof by the user. The upper portion of the bag is left uncoated, thus retaining its air permeable properties.

In addition, a cover member is preferably provided for covering a gripping handle portion of the pneumatic nail gun. The cover member includes laterally opposed first and second side edges, with the first side edge being secured to a sidewall of the bag. The cover member is preferably formed from the same material that coats the lower portion of the bag, thus providing enhanced frictional gripping of the handle portion by the user.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
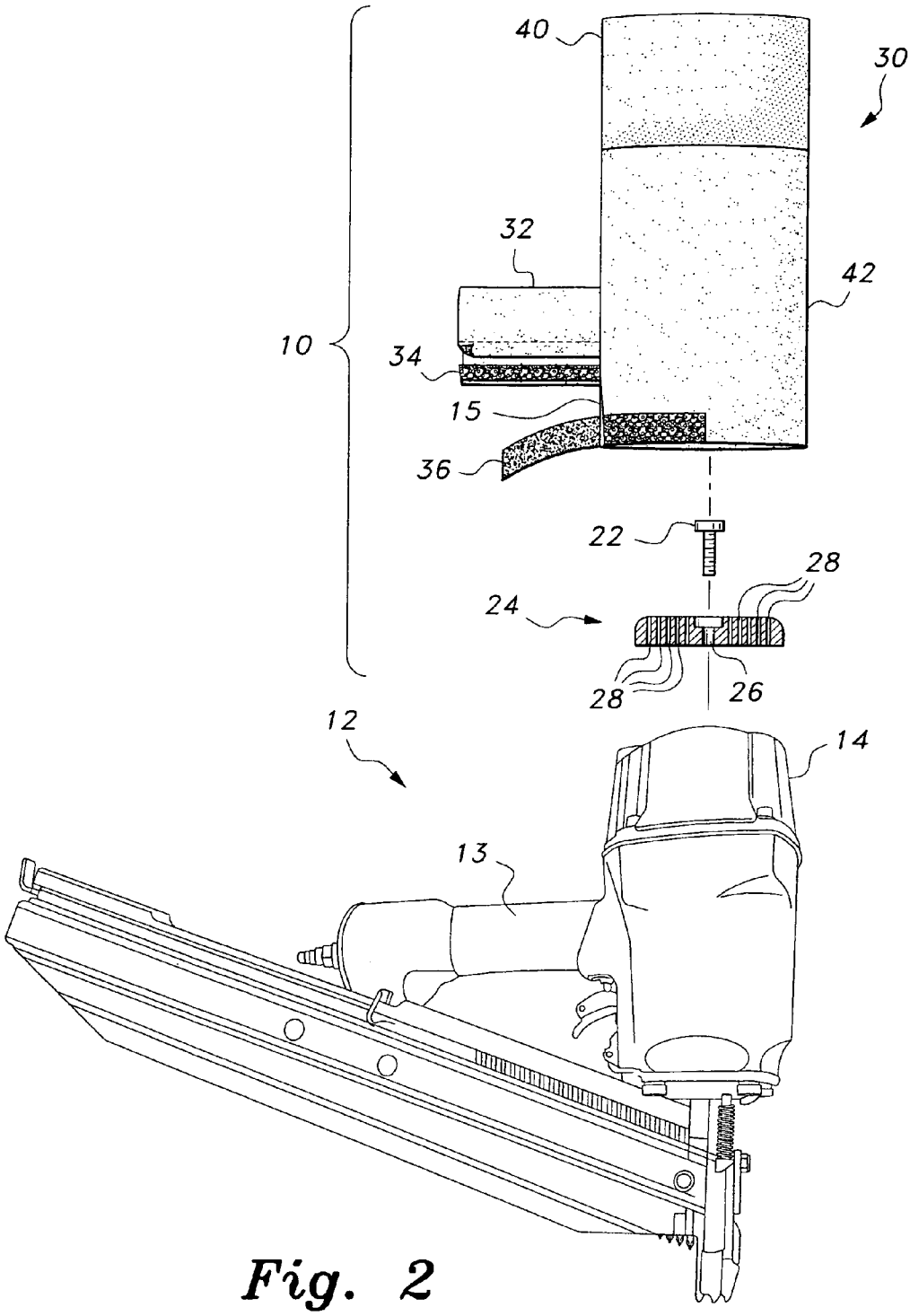
FIG. 2 is an exploded environmental view of an exhaust gas diffuser and filter system for a pneumatic nail gun according to the present invention, the diffuser plate being shown in section.

The present invention is directed to an exhaust gas diffuser and filter system 10 for a pneumatic nail gun, which provides for the diffusion and filtering of exhaust gas, which is typically pressurized air, generated by operation of a pneumatic nail gun, such as exemplary pneumatic nail gun 12, during usage thereof. As illustrated in FIG. 2, the system 10 includes a diffuser plate 24 adapted for covering the exhaust ports 16 of the pneumatic nail gun 12, and further includes a bag 30 formed from an air permeable material, allowing for further diffusion and filtering of the exhaust gas.

Figure 3:
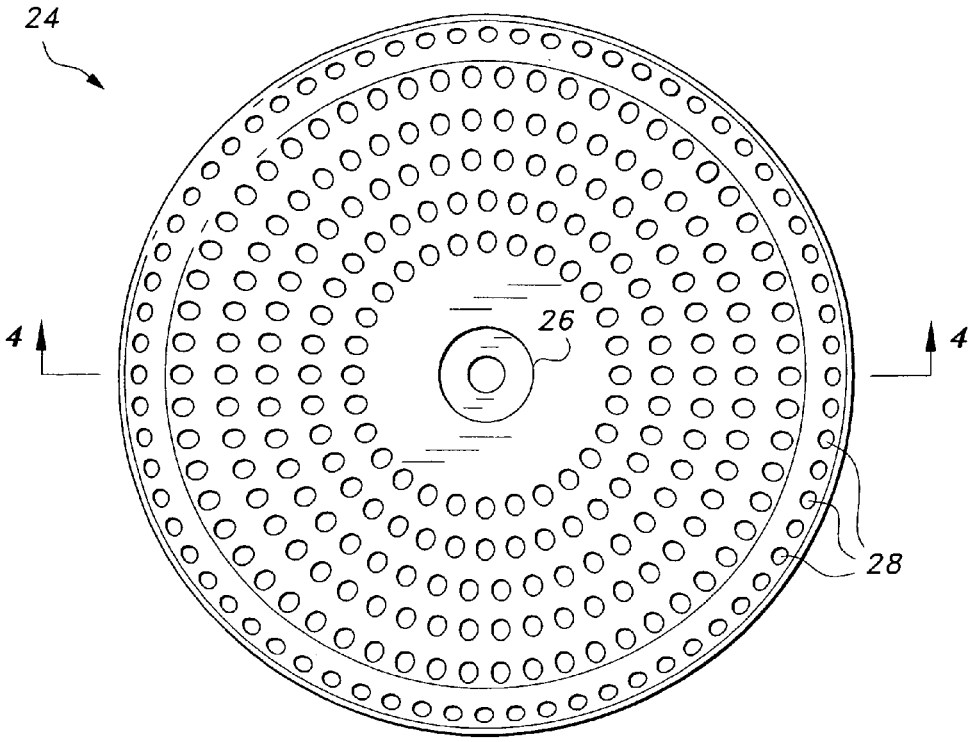
FIG. 3 is a front view of an alternative embodiment of an exhaust gas diffuser plate according to the present invention.

The diffuser plate 24 has a plurality of fluid passages 28 formed therethrough, and is adapted for releasable mounting on the upper exhaust portion 14 of the pneumatic nail gun 12. The plurality of fluid passages 28 diffuse the exhaust gas produced by the pneumatic nail gun 12 during use. The diffuser plate 24 is shaped for attachment to the exhaust portion of a nail gun, which generally has a substantially circular cross-sectional shape, as best shown in FIG. 3. Diffuser plate 24 may be formed from metal, wood, plastic or any other suitable material.

Figure 1:
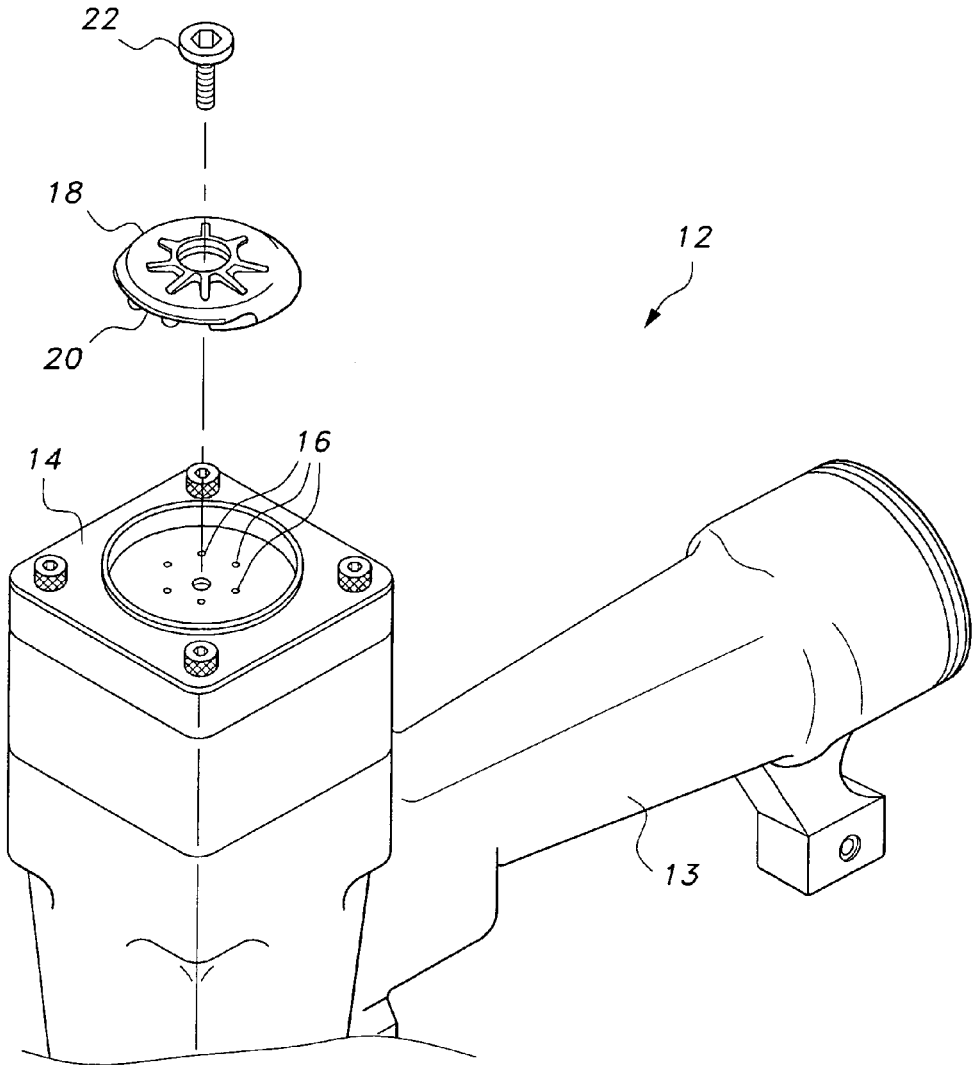
Fig. 1 PRIOR ART
FIG. 1 is a partial environmental perspective view of a prior art exhaust system for a pneumatic nail gun.

Preferably, the diffuser plate 24 has an axial bore 26 formed therethrough, which may be countersunk, for receiving a bolt 22 or the like for attaching the diffuser plate 24 to the exhaust portion 14 of the pneumatic nail gun 12. Typical pneumatic nail guns, such as the exemplary nail gun 12, include cover plates, such as cover plate 18 (of the prior art system shown in FIG. 1). Preferably, the diffuser plate 24 replaces cover plate 18, and the original bolt 22, which was used to secure the cover plate 18 to the upper portion 14, may be used to secure the diffuser plate 24 to the exhaust portion.

Figure 4:
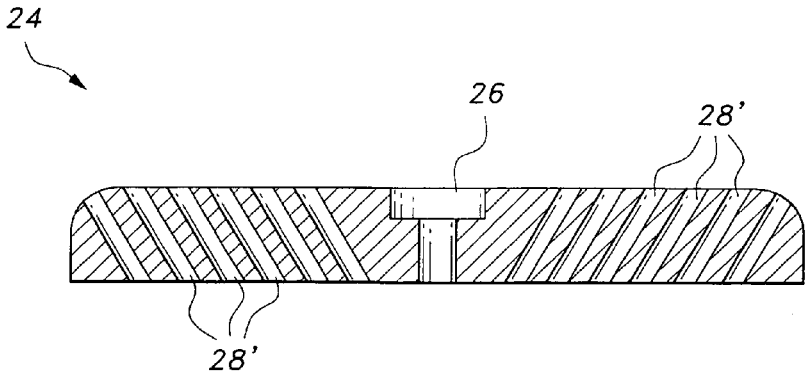
FIG. 4 is a section view taken along lines 4-4 of FIG. 3.

In the embodiment of FIG. 2, air passages 28 are each formed to extend in the axial direction, parallel to the axial bore 26. However, in the alternative embodiment illustrated in FIGS. 3 and 4, fluid passages 28' are each formed at an angle with respect to the axial direction of the diffuser plate 24. Fluid passages 28' may each be arranged at a separate angle with respect to one another in order to maximize diffusion of the exhaust gas therethrough. In the preferred embodiment, the fluid passages are positioned and angled to maximize diffusion of the exhaust gas, thus muffling exhaust noise as the exhaust gas flows therethrough.

The bag 30, best shown in FIG. 2, includes an upper closed portion 40 and a lower open portion 42, and is sized and shaped to cover the exhaust portion 14 of the pneumatic nail gun 12. The bag 30 is preferably formed from an at least partially air permeable material. Preferably, the entire bag 30 is formed from an air permeable material, such as the dust collection fabric manufactured by Woodtech USA, canvas, heavy cloth or any other air permeable material, which is adapted for exhaust gas diffusion and filtering. The lower portion 42 of the bag 30 is preferably coated with a material having a relatively high coefficient of friction, such as vinyl or rubber, allowing for enhanced gripping thereof by the user. The upper portion 40 of the bag 30 is left uncoated, thus retaining its air permeable properties. The bag 30 serves to further baffle noise and diffuse exhaust air so that the burst of exhaust does not stir up dust and debris, which may be hazardous to the respiratory system and a hazard to the eyes.

In addition, a cover member 32 is preferably provided for covering a gripping handle portion 13 of the pneumatic nail gun 12. The cover member 32 includes laterally opposed first and second side edges, with the first side edge being secured to a sidewall of the bag 30, as shown. The cover member 32 is preferably formed from the same material that coats the lower portion 42 of the bag 30, thus providing enhanced frictional gripping of the handle portion 13 by the user.

The cover member 32 defines a passage for releasably receiving the pistol grip handle portion 13, and may be releasably secured thereto by any suitable means for releasably fastening the lower free edges of the cover member 32 to one another, such as hook and loop type fasteners 34. The passage defined by cover member 32 is preferably in communication with the open interior region of bag 30, allowing for a secure fit of bag 30 and cover member 32 over the pneumatic nail gun 12.

Further, a slit 15 is preferably formed in the sidewall of lower portion 42 of bag 30 adjacent the passage defined by cover member 32, allowing the lower portion 42 of bag 30 to slide over the gripping handle portion 13. Preferably, means for closing the slit 15 are provided, such as a hook and loop type fastener. In FIG. 2, an exemplary strip of a hook fastener 36 is shown secured to lower portion 42 for releasable attachment to a complementary loop fastener secured to an outer surface of the bag 30. It should be understood that any suitable releasable closure means may be used.

In use, the user removes the cover plate 18 (of FIG. 1) from nail gun 12, and replaces the cover plate 18 with the diffuser plate 24, preferably using bolt 22 to secure the diffuser plate to the exhaust portion 14 of pneumatic nail gun 12. The user then covers the exhaust portion 14 with bag 30, with air permeable upper portion 40 of bag 30 being positioned adjacent to and covering the diffuser plate 24. The gripping cover portion 32 receives the gripping handle 13 of nail gun 12 within the passage defined therein, and hook and loop fasteners 34 releasably seal the cover portion 32 about the gripping handle 13. Slit 15 of bag 30 is then preferably closed through use of hook and loop fasteners 36. The plurality of fluid passages 28, 28' diffuse the exhaust gas produced by the pneumatic nail gun 12 during use.

The bag 30 provides for further diffusion of the exhaust gas, and further provides filtering thereof. The diffusion of the exhaust gas provides for muffling of the sound produced during usage of the nail gun 12, and further prevents a high-powered stream of exhaust gas from impinging directly on the user, or on contaminants, such as a pile of sawdust on a work surface, which may then be released in the air. The bag 30 provides for further diffusion and muffling, and additionally filters contaminants from the exhaust gas prior to entering the user's environment.

It is to be understood that the present invention is not limited to the embodiments described above, but encompasses any and all embodiments within the scope of the following claims.

I claim:

1. A pneumatic nail gun exhaust gas diffuser and filter system, comprising:

a pneumatic nail gun having a pistol grip and a pneumatic air chamber housing extending normal to the pistol grip, the pneumatic air chamber housing defining an exhaust opening for ejecting a jet of exhaust gas during a nailing cycle;

a diffuser plate having a plurality of fluid passages formed therethrough, the diffuser plate being attached to the pneumatic air chamber housing and covering the exhaust opening, the plurality of fluid passages being adapted for diffusing the jet of exhaust gas released by the pneumatic nail gun during a nailing cycle;

a bag having an upper closed portion and a lower open portion, the bag covering the exhaust opening of the pneumatic air chamber housing, the bag being at least partially formed from an air permeable material, the bag further muffling exhaust noise and diffusing the jet of exhaust gas to prevent dust and debris from being stirred up; and a cover member extending from said bag, the cover member covering the pistol grip and having releasable fasteners for securing the cover member to the pistol grip.

2. An exhaust gas diffuser and filter system for a pneumatic nail gun, comprising:

a diffuser plate having a plurality of fluid passages formed therethrough, the diffuser plate being adapted for attachment to an exhaust portion of the pneumatic nail gun and for covering exhaust ports thereof, the plurality of fluid passages being adapted for diffusing exhaust gas released by the pneumatic nail gun; and a bag having an upper closed portion and a lower open portion, the bag being sized and shaped to cover the exhaust portion of the pneumatic nail gun, the bag being at least partially formed from an air permeable material, the bag further muffling exhaust noise and diffusing a jet of exhaust air to prevent dust and debris from being stirred up, wherein said bag further includes a strap secured to the lower open portion of said bag and extending outwardly therefrom, a first hook and loop fastener attached to the strap, and a mating hook and loop fasteners attached to an outer surface of the bag for attaching the lower portion of said bag to the pneumatic nail gun.

3. The exhaust gas diffuser and filter system as recited in claim 2, further comprising means for securing the lower open portion of the bag to the pneumatic nail gun.

4. The exhaust gas diffuser and filter system as recited in claim 3, wherein the means for securing the lower open portion of the bag to the pneumatic nail gun comprises hook and loop fasteners.

5. The exhaust gas diffuser and filter system as recited in claim 2, further comprising a cover member extending from said bag for releasably covering a gripping handle portion of the pneumatic nail gun.

6. The exhaust gas diffuser and filter system for a pneumatic nail gun as recited in claim 5, wherein the cover member has laterally opposed first and second side edges, the first side edge being secured to a sidewall of said bag.

7. The exhaust gas diffuser and filter system for a pneumatic nail gun as recited in claim 6, further comprising means for releasably securing the cover member to the gripping handle portion of the pneumatic nail gun.

8. The exhaust gas diffuser and filter system for a pneumatic nail gun as recited in claim 2, further comprising means for securing said diffuser plate to the exhaust portion of the pneumatic nail gun.

9. The exhaust gas diffuser and filter system for a pneumatic nail gun as recited in claim 8, wherein said diffuser plate has an axial bore defined therein, said means for securing said diffuser plate to the exhaust portion of the pneumatic nail gun comprising a bolt extending through the axial bore.

10. The exhaust gas diffuser and filter system for a pneumatic nail gun as recited in claim 2, wherein the plurality of fluid passages each extend in a substantially axial direction through said diffuser plate.

11. The exhaust gas diffuser and filter system for a pneumatic nail gun as recited in claim 2, wherein at least a portion of the plurality of fluid passages extend obliquely through said diffuser plate.

12. The exhaust gas diffuser and filter system for a pneumatic nail gun as recited in claim 2, further comprising a cover member extending from said bag for releasably covering a gripping handle portion of the pneumatic nail gun, the cover member having mating hook and loop fasteners for releasably securing the cover member to the gripping handle portion of the pneumatic nail gun.

13. The exhaust gas diffuser and filter system for a pneumatic nail gun as recited in claim 1, wherein the lower open portion of said bag is formed from an air-impermeable material.

14. The exhaust gas diffuser and filter system for a pneumatic nail gun as recited in claim 2, wherein said diffuser plate has an axial bore defined therein, the axial bore being positioned substantially centrally in said diffuser plate.

15. The exhaust gas diffuser and filter system for a pneumatic nail gun as recited in claim 2, wherein said diffuser plate is substantially circular in cross section.

16. An exhaust gas diffuser and filter system for a pneumatic nail gun comprising:

a diffuser plate having a plurality of fluid passages formed therethrough the diffuser plate being adapted for attachment to an exhaust portion of the pneumatic nail gun and for covering exhaust ports thereof, the plurality of fluid passages being adapted for diffusing exhaust gas released by the pneumatic nail gun; and a bag having an upper closed portion and a lower open portion, the bag being sized and shaped to cover the exhaust portion of the pneumatic nail gun, the bag being at least partially formed from an air permeable material, the bag further muffling exhaust noise and diffusing a jet of exhaust air to prevent dust and debris from being stirred up; and a cover member extending from said bag for releasably covering a gripping handle portion of the pneumatic nail gun, the cover member defining a passage adapted for releasably receiving the gripping handle portion of the pneumatic nail gun.

17. The exhaust gas diffuser and filter system for a pneumatic nail gun as recited in claim 16, wherein said bag defines an open interior region therein, the open interior region of said bag being in communication with the passage defined by the cover member.

* * * * *